United States Patent [19]

Honders et al.

[11] Patent Number: 4,851,089

[45] Date of Patent: Jul. 25, 1989

[54] PROCESS FOR THE ELECTROLYTIC PRODUCTION OF METALS

[75] Inventors: Anthonie Honders; Alfred J. Horstik; Gerbrand J. M. Van Eyden, all of Arnhem, Netherlands

[73] Assignee: Shell Internationale Research Maatschappij B.V. Carel Va N Bylandtlaan, The Hague, Netherlands

[21] Appl. No.: 167,751

[22] Filed: Mar. 15, 1988

[30] Foreign Application Priority Data

Apr. 1, 1987 [GB] United Kingdom ..... 8707781

[51] Int. Cl.[4] ..... C25C 3/00

[52] U.S. Cl. ..... 204/60; 204/59 M

[58] Field of Search ..... 204/60, 39, 59

[56] References Cited

U.S. PATENT DOCUMENTS

| | | | |
|---|---|---|---|
| 2,757,135 | 7/1956 | Gleave et al. | 204/71 |
| 2,861,030 | 11/1958 | Slatin | 204/71 |
| 3,087,873 | 4/1963 | Slatin | 204/64 |
| 3,444,058 | 5/1969 | Mellors et al. | 204/39 |
| 4,738,759 | 4/1988 | Bienvenu et al. | 204/60 |

FOREIGN PATENT DOCUMENTS

| | | |
|---|---|---|
| 0039873 | 11/1981 | European Pat. Off. . |
| 1139985 | 11/1962 | Fed. Rep. of Germany . |
| 40-12961 | 6/1965 | Japan . |
| 660908 | 11/1951 | United Kingdom . |

*Primary Examiner*—John F. Niebling
*Assistant Examiner*—William T. Leader
*Attorney, Agent, or Firm*—Jones, Tullar & Cooper

[57] ABSTRACT

A process for the production of metal Me and/or an alloy containing metal Me from a complex metal halide $A_mMeX_o$ by electroylsis in a cell comprising an anode, a liquid metal cathode comprising one or more metals M and a liquid electrolyte comprising a salt melt of one or more alkali metal or alkaline earth metal halides, which comprises introducing complex metal halide $A_mMeX_o$, in which A represents an alkali metal, Me represents a metal, X represents halogen and o represents the valency of Me plus m, into the liquid metal cathode and isolating Me and/or an alloy containing Me from the metal cathode material.

21 Claims, 1 Drawing Sheet

PROCESS FOR THE ELECTROLYTIC PRODUCTION OF METALS

CROSS REFERENCE TO RELATED APPLICATIONS

This application discloses subject matter in common with application Ser. Nos. 167,752 and 167,753, both filed on Mar. 15, 1988.

TECHNICAL FIELD

The invention relates to a process for the production of metals or alloys by electrolysis of complex metal halides in a cell comprising an anode, a liquid metal cathode and a liquid electrolyte.

BACKGROUND OF THE INVENTION

Winning metals by electrolysis in the presence of molten salts is an area in which increasing research is being carried out. An embodiment of this process is known from U.S. Pat. No. 2,757,135. In this event titanium tetrachloride, is supplied to the electrolysis cell by introduction into the salt melt. In practice, that process has to be carried out with a diaphragm that prevents the flow of titanium in lower valencies to the anode. If this were not done, the titanium would be re-oxidized at the anode to tetravalent titanium and would thus give rise to a loss of current and raw material. Furthermore, the build-up of titanium in the diaphragm shortens its life, which is a significant disadvantage.

SUMMARY OF THE INVENTION

The present invention, now, proposes a process for the production of metal Me and/or an alloy containing metal Me from a complex metal halide $A_mMeX_o$ by electrolysis in a cell comprising an anode, a liquid metal cathode comprising one or more metals M and a liquid electrolyte comprising a salt melt of one or more alkali metal or alkaline earth metal halides, which comprises introducing complex metal halide $A_mMeX_o$, in which A represents an alkali metal, Me represents a metal, X represents halogen and o represents the valency of Me plus m, into the liquid metal cathode and isolating Me and/or an alloy containing Me from the metal cathode material.

BRIEF DESCRIPTION OF THE DRAWINGS

The invention will be discussed in more detail with reference to FIGS. 1 and 2, which illustrate possible electrolytic cells, taking the electrolysis of $K_2TiF_6$ to produce metallic titanium in a liquid zinc cathode as example.

DETAILED DESCRIPTION OF THE PREFERRED EMBODIMENTS

Figure 1:
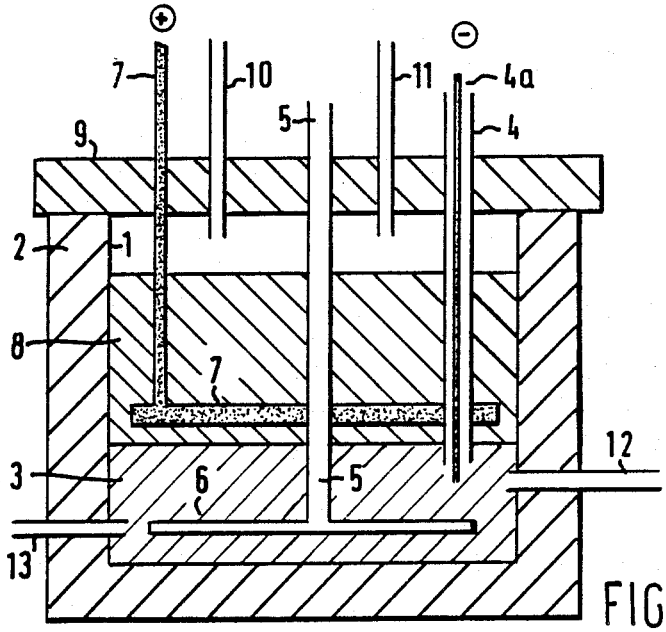
FIG. 1 is a cross-sectional view of an electrolytic cell in accordance with one embodiment of the invention.

In FIG. 1 cell 1 is in a jacket of thermally insulating material 2, for example refractory brick. Cathode 3 consists of liquid zinc to which current is fed via insulating pipe 4 and feed rod 4a. Supply of the complex halide, for instance $K_2TiF_6$, may take place via pipe 5 and a distributor 6, for example a metal grid with outlets at intervals, for instance by using a stream of argon gas containing a complex halide powder. Anode 7 is positioned in electrolyte 8 near the interface between cathode and electrolyte. The horizontal surface area of the anode is chosen to be as large as possible. Electrolyte 8, for example a lithium chloride/potassium chloride melt, is heated to a high temperature, for example 350° to 900° C. or higher if operations are carried out under pressure. Through lid 9 runs a supply pipe 10 for inert gas, for example argon, and a discharge pipe 11 for chlorine and/or fluorine gas which is generated at the anode. The current and the supply of the complex halide are adjusted to match each other such that all or substantially all metal is reduced in the cathode, thus forming a zinc/metal alloy and/or mixture. This means that the anode does not need to be shielded by a diaphragm. If desired, the cell can also be provided with means for temperature control of the process. The space above electrolyte 8 can also be cooled or any vaporized salt melt of zinc can be internally or externally condensed and fed back. Supply and discharge of cathode liquid takes place via lines 12 and 13, in particular in the continuous embodiment. The metal content in the Zn/Me alloy and/or mixture will be allowed to increase to a predetermined value. Recovery of the metal from the alloy may be carried out by conventional methods, e.g. by distilling off cathode metal or metal Me.

Figure 2:
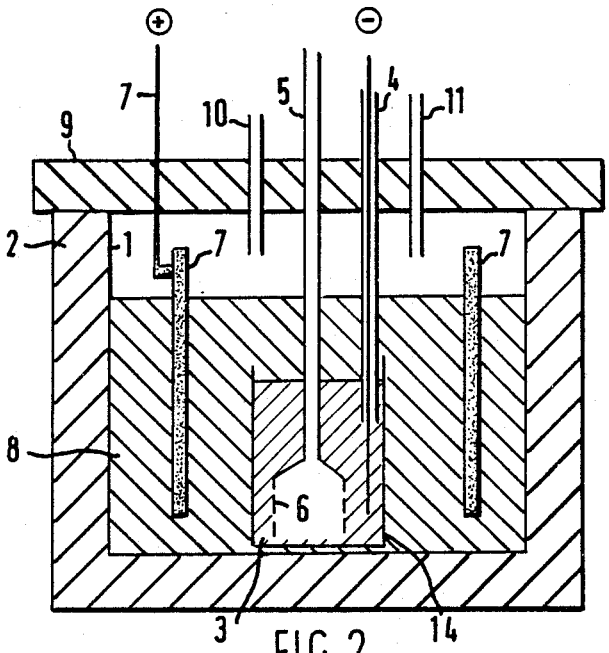
FIG. 2 is a cross-sectional view of an electrolytic cell in accordance with another embodiment of the invention.

FIG. 2 shows a cell with a vertically positioned anode. The same reference numerals have been retained for the same elements of the construction. In the salt melt a tray 14 is placed in which liquid zinc is present. The complex halide may now enter via perforations in the lower part of supply pipe 5. Anode 7 is constructed as a closed cylinder which completely surrounds the cathode.

Although in the preceding section the process of this invention has been described by reference to a preferred embodiment, i.e. production of titanium from potassium titanium hexafluoride employing a liquid zinc cathode, the invention is not limited thereto. Analogous processing can be carried out with different cathode materials, i.e. cadmium, aluminium, tin, lead, indium, bismuth and gallium. Zinc, tin and lead are preferred. Likewise other feedstocks may be processed, i.e. complex halides of metals selected from the groups 1b, 2b, 3a, 3b, including the lanthanide series and the actinide series, 4a, 4b, 5a, 5b, 6b, 7b and 8 of the periodic table, for instance, $KAuBr_4$, $K_2PbBr_6$, $Na_2IrCl_6$, $K_2IrCl_6$, $K_4IrCl_6$, $K_2PdCl_4$, $K_2PbCl_6$, $Na_2SnF_6$, $K_2SnCl_6$, $K_2ReCl_6$, $K_2RhCl_5$, $K_2OsCl_6$, $K_2RuCl_6$, $K_2MnF_6$, $K_2TiF_6$, $K_2TaF_7$, $K_2ThF_6$, $K_2ZrF_6$, $K_2NbF_7$, $K_2HgI_4$ and $Na_3AlF_6$. Preferred alkali metals A are lithium, sodium or potassium. Preferred complex halides to be processed are those of titanium ($K_2TiF_6$) and tantalum ($K_2TaF_7$). The preferred halogen atom is chlorine or fluorine.

It is not known to what extent the production of metal Me proceeds via direct electrolytic conversion of for example $Ti^{4+} \rightarrow +4e \rightarrow Ti$. Introduction of $K_2TiF_6$ into a liquid zinc cathode at elevated temperature may result in a chemical reduction of metal Me to lower valencies, for example $2K_2TiF_6 + Zn \rightarrow 2TiF_3 + ZnF_2 + 4KF$, this may then be followed by electrolytic reduction of trivalent titanium to metallic (zerovalent) titanium, coupled with electrolytic regeneration of cathode material by reducing divalent zinc to metallic (zerovalent) zinc. Such combined chemical and electrolytic reductions of metal Me in a higher valency to zerovalent metal are included expressis verbis in the scope of this invention, so is the production of zerovalent tantalum from $K_2TaF_7$ in a liquid zinc cathode which probably proceeds entirely via chemical reduction by metallic zinc and electrolytic regeneration (reduction) of cathode material. What is essential to this invention is the application of an electrolytic cell with a liquid metal or alloy cathode, an introduction of complex metal halide $A_mMeX_o$ directly into the liquid cathode and production of (zerovalent) metal Me within the cathode material, the latter as distinguished from production of metal Me somewhere else, i.e. in the molten salt electrolyte or by deposition on a second or auxiliary cathode. As will be clear from FIGS. 1 and 2 the cathode is not of bipolar construction but is a conventional monopolar cathode. Absence of a diaphragm is also important.

The salt melts may be free from impurities but this is not strictly necessary, while in addition it may be advantageous to work under an inert atmosphere of, for example, argon or nitrogen. Examples of suitable salt melts are LiCl/NaCl, NaCl/KCl, LiCl/KCl, LiF/KF, $LiCl/CaCl_2$, $NaCl/BaCl_2$ and $KCl/CaCl_2$, but, as has already been pointed out, the invention is not limited to the above-mentioned melts.

In principle, suitable processing temperatures are above the melting point of the cathode material and below the temperature at which that material has such a vapour pressure that undesirably large losses occur. Preferred temperatures are between 350° and 900° C., for zinc 425° to 890° C., for cadmium 350° to 750° C. Similarly, the processing temperature should not be so high that loss of molten salt electrolyte or metal Me by evaporation or decomposition becomes substantial.

The current and the supply of metal halide feedstock are so adjusted that complete reduction of metal Me in the cathode can take place. Preferably, at least n $F.mol^{-1}$ complex metal halide $A_mMeX_o$ is supplied, n being the valency of the metal. The current is, however, restricted to a certain maximum, since net deposition of salt-melt metal in the cathode should preferably be prevented as far as possible. The feedstock should preferably be introduced under homogeneous distribution into the cathode. The easiest way for achieving this is by using feedstocks that are in gaseous form on the moment of their introduction into the cathode material. However, introduction into the cathode of compounds in finely dispersed, solid or liquid form is also included within the scope of this invention. This all results in no metal Me, or practically none, in any valency ending up in the salt melt. It is then not necessary to employ a diaphragm to shield the anode, so that no undesired current, feed stock and voltage losses occur, resulting in great technical and economical benefits. Cells having no diaphragm are preferred.

To isolate metal Me and/or alloys containing Me, cathode material is withdrawn from the electrolysis cell. In this respect it is remarked that, depending on the cathode metal M and the complex metal halide used, sometimes a liquid alloy is obtained, sometimes solid intermetallic particles in the liquid metal cathode are obtained, and sometimes a two phase liquid or liquid/solid system is obtained, or complex systems are formed comprising mixtures of the possibilities described hereinbefore.

The invention is elucidated below by a number of experiments.

EXAMPLE I a. 1.5 kg of eutectic LiCl/KCl mixture (59:41 mol) was purified by passing HCl gas through it at above its melting point of 8 hours. The HCl forces the equilibria (a) and (b) shown below to the left, so that an anhydrous, almost oxygen-free melt is obtained.

$$Cl^- + H_2O \rightarrow HCl + OH^- \quad (a)$$

$$2Cl^- + H_2O \rightarrow 2HCl + O^{2-} \quad (b)$$

Residual oxygen compounds and metallic impurities are then removed by electrolysis under vacuum at a cell voltage of 2.7 V.

An electrolytic cell of externally heated stainless steel was employed with a molten zinc cathode (90 g) which was placed in a holder of $Al_2O_3$ on the bottom of the cell. A graphite rod served as anode, no diaphragm was used and 250 g salt melt was used as electrolyte. The cell voltage was 5.0 V, the cathode potential was −2.0 V (relative to an Ag/AgCl reference electrode) and the other conditions are given in the Table. An argon atmosphere was maintained above the salt melt. The following results were determined by microprobe and chemical analysis of the cooled cathode products and electrolyte.

TABLE

| Cathode | Feedstock | Temp. | Time | Current density | Cathode analysis (% g/g) | | | | Electrolyte analysis (% m/m) | |
|---|---|---|---|---|---|---|---|---|---|---|
| M | $MeX_n$ | (°C.) | (min) | (A. $cm^{-2}$) | M | Me | Li | K | M | Me |
| Zn | $K_2TiF_6$ | 780 | 130 | 1 | 98 | 0.29 | 0.004 | <0.005 | 0.01 | 0.005 |
| Zn | $K_2TaF_7$ | 775 | 115 | 1 | 92 | 0.3 | 0.37 | 0.006 | <0.001 | <0.02 |
| Zn | $Na_2SnF_6$ | 750 | 120 | 1 | >90 | 1.4 | | n.d. | n.d. | n.d. |
| Zn | $K_2ZrF_6$ | 750 | 120 | 1 | >90 | 1.2 | | n.d. | n.d. | n.d. |
| Zn | $K_2NbF_7$ | 750 | 120 | 1 | >90 | 1.2 | | n.d. | n.d. | n.d. |
| Zn | $K_2IrCl_6$ | 750 | 120 | 1 | >90 | 1.3 | | n.d. | n.d. | n.d. |

Electrolyte: LiCl/KCL
n.d. = not determined

We claim:

1. A process for the production of metal Me and/or an alloy containing metal Me from a complex metal halide $A_mMeX_o$ by electrolysis in a cell comprising an anode, a liquid metal cathode comprising one or more metals M and a liquid electrolyte comprising a salt melt of one or more alkali metal halides or alkaline earth metal halides, which comprises: introducing complex metal halide $A_mMeX_o$ into the liquid metal cathode; and isolating Me and/or an alloy containing Me from the liquid metal cathode material, wherein A represents an alkali metal, Me represents a metal, X represents halogen and o represents the valency of Me plus m.

2. A process as claimed in claim 1, in which Me is selected from the group consisting of groups 1b, 2b, 3a, 3b, including the lanthanide series and actinide series, 4a, 4b, 5a, 5b, 6b, 7b and 8 of the periodic system.

3. A process as claimed in claim 2, in which Me is selected from the group consisting of Ti and Ta.

4. A process as claimed in any one of claims 1 to 3, in which A is selected from the group consisting of K, Li and Na.

5. A process as claimed in claim 4, in which X is selected from the group consisting fluorine and chlorine.

6. A process as claimed in claim 4, in which M is selected from the group consisting of Zn, Cd, Al, Sn, Pb, In, Bi and Ga.

7. A process as claimed in claim 4, in which the alkali metal halides or alkaline earth metal halides are fluorides or chlorides.

8. A process as claimed in claim 4, which is carried out in an electrolytic cell having no diaphragm.

9. A process as claimed in any one of claims 1 to 3, in which X is selected from the group consisting of fluorine and chlorine.

10. A process as claimed in claim 9, in which M is selected from the group consisting of Zn, Cd, Al, Sn, Pb, In, Bi and Ga.

11. A process as claimed in claim 9, in which the alkali metal halides or alkaline earth metal halides are fluorides or chlorides.

12. A process as claimed in claim 9, which is carried out in an electrolytic cell having no diaphragm.

13. A process as claimed in any one of claims 1 to 3, in which M is selected from the group consisting of Zn, Cd, Al, Sn, Pb, In, Bi and Ga.

14. A process as claimed in claim 13, in which the alkali metal halides or alkali earth metal halides are fluorides or chlorides.

15. A process as claimed in claim 13, which is carried out in an electrolytic cell having no diaphragm.

16. A process as claimed in claim 13, in which M is selected from the group consisting of Zn, Sn and Pb.

17. A process as claimed in claim 16, in which the alkali metal halides or alkaline earth metal halides are fluorides or chlorides.

18. A process as claimed in claim 16, which is carried out in an electrolytic cell having no diaphragm.

19. A process as claimed in any one of claims 1 to 3, in which the alkali metal halides or alkaline earth metal halides are fluorides or chlorides.

20. A process as claimed in claim 19, which is carried out in an electrolytic cell having no diaphragm.

21. A process as claimed in any one of claims 1 to 3, which is carried out in an electrolytic cell having no diaphragm.

* * * * *